United States Patent [19]

Satterwhite

[11] 3,987,564

[45] Oct. 26, 1976

[54] OUTSIDE SUPPORTS FOR EXCAVATING WHEELS

[75] Inventor: Charles R. Satterwhite, Dallas, Tex.

[73] Assignee: Unit Rig & Equipment Co., Tulsa, Okla.

[22] Filed: July 17, 1975

[21] Appl. No.: 596,576

Related U.S. Application Data

[63] Continuation-in-part of Ser. No. 435,296, Jan. 21, 1974, Pat. No. 3,896,571.

[52] U.S. Cl. ..... 37/190; 299/76

[51] Int. Cl.[2] ..... E02F 3/24

[58] Field of Search ..... 37/189, 190, 94–97, 37/91, DIG. 2, 86; 299/74–78, 73

[56] References Cited

UNITED STATES PATENTS

| | | | |
|---|---|---|---|
| 818,215 | 4/1906 | Anderson | 37/95 |
| 853,985 | 5/1907 | Linga | 37/94 |
| 1,455,206 | 5/1923 | Howe et al. | 37/197 |
| 1,482,904 | 2/1924 | Moore et al. | 37/97 |
| 1,858,327 | 5/1932 | Hays | 37/190 X |
| 2,748,505 | 6/1956 | Turner | 37/96 |
| 2,762,141 | 9/1956 | Le Tourneau | 37/190 |
| 3,052,455 | 9/1962 | McLaughlin et al. | 299/76 |
| 3,290,096 | 12/1966 | Stalker | 299/78 |
| 3,487,565 | 1/1970 | Grandin | 37/189 |
| 3,500,563 | 3/1970 | Smith | 37/190 |

FOREIGN PATENTS OR APPLICATIONS

| | | | |
|---|---|---|---|
| 722,876 | 3/1932 | France | 37/190 |
| 632,711 | 7/1936 | Germany | 37/96 |

*Primary Examiner*—E. H. Eickholt
*Attorney, Agent, or Firm*—Richards, Harris and Medlock

[57] ABSTRACT

An excavating and loading system includes an excavating wheel assembly at the front thereof and a plurality of conveyors for conveying material from the excavating wheel assembly upwardly and rearwardly. The excavating wheel assembly includes at least one excavating wheel which is wider than the overall width of the following portion of the system. A supporting and housing apparatus rotatably supports the excavating wheel and includes portions which engage the ends of the excavating wheel. Apparatus is provided for raising and lowering the supporting and housing apparatus to raise and lower the excavating height of the excavating wheel assembly and thereby vary the grade of the excavation. The excavation wheel is provided with means for positively moving the walls of a plurality of buckets between digging and dumping positions.

13 Claims, 7 Drawing Figures

OUTSIDE SUPPORTS FOR EXCAVATING WHEELS

CROSS REFERENCE TO RELATED APPLICATION

This application is a continuation-in-part of copending application Ser. No. 435,296, Jan. 21, 1974, for EXCAVATING AND LOADING SYSTEM, now U.S. Pat. No. 3,896,571 issued July 29, 1975 and entitled MULTI-WHEELED EXCAVATOR AND CONVEYING SYSTEM.

BACKGROUND OF THE INVENTION

The present invention relates to improvements in excavating and loading systems which form an excavation of a sufficient width to allow the following portion of the system to move through the excavation.

In large excavating and loading systems, for example, of the type capable of loading 4,000 cu. yds. of earth per hour, it has heretofore been known to utilize a system which forms a trench in the ground of a sufficient width to allow the system to move through the trench behind the excavating portion of the system. However, although various examples of such excavating and loading systems have been designed previously, the need persists for considerable improvement in the art.

In accordance with the broader aspects of the invention, an improved excavating and loading system is disclosed having a vehicle and an excavating wheel assembly supported at the front of the vehicle. The excavating wheel assembly is wider than the following portions of the vehicle and forms an excavation which is wider than the portion of the vehicle positioned in the excavation. Supporting and housing apparatus is mounted on the front of the vehicle and extends from the ends of the excavating wheel assembly at a point above the ground surface when the system is in operation.

In accordance with the preferred embodiment of the invention, an improved excavating and loading system is disclosed having a vehicle which comprises a main frame which is supported from the ground surface by driven wheels. A subframe is pivotally supported from the main frame so that the front end of the subframe can be vertically raised and lowered with respect to the main frame. Supporting and housing apparatus rotatably supports an excavating wheel assembly at the front of the vehicle. The supporting and housing apparatus has a yoke portion which engages the ends of the wheel assembly. The yoke extends axially beyond the ends of the wheel assembly at a height greater than the ultimate depth of the excavation. A blade and a bearing plate are connected to the lower portions of the main and subframes for stabilizing the excavating wheel assembly. The excavating wheel assembly includes a plurality of digging buckets each including a wall which is supported for pivotal movement between a material receiving position and a material dumping position. Structure is provided for rotating the excavating wheel assembly and for pivoting the movable walls of the buckets to first receive material and to subsequently dump the material onto a main conveyor. A main conveyor is mounted on the vehicle to receive material from the excavating wheel assembly and to transport the material upwardly and rearwardly. An auxiliary conveyor with inner and outer portions can be provided on the rear of the vehicle for receiving material from the main conveyor and transporting material rearwardly and/or laterally.

DESCRIPTION OF THE DRAWINGS

A more complete understanding of the present invention may be had by referring to the following Detailed Description when taken in conjunction with the accompanying Drawings wherein.

DETAILED DESCRIPTION

Figure 1:
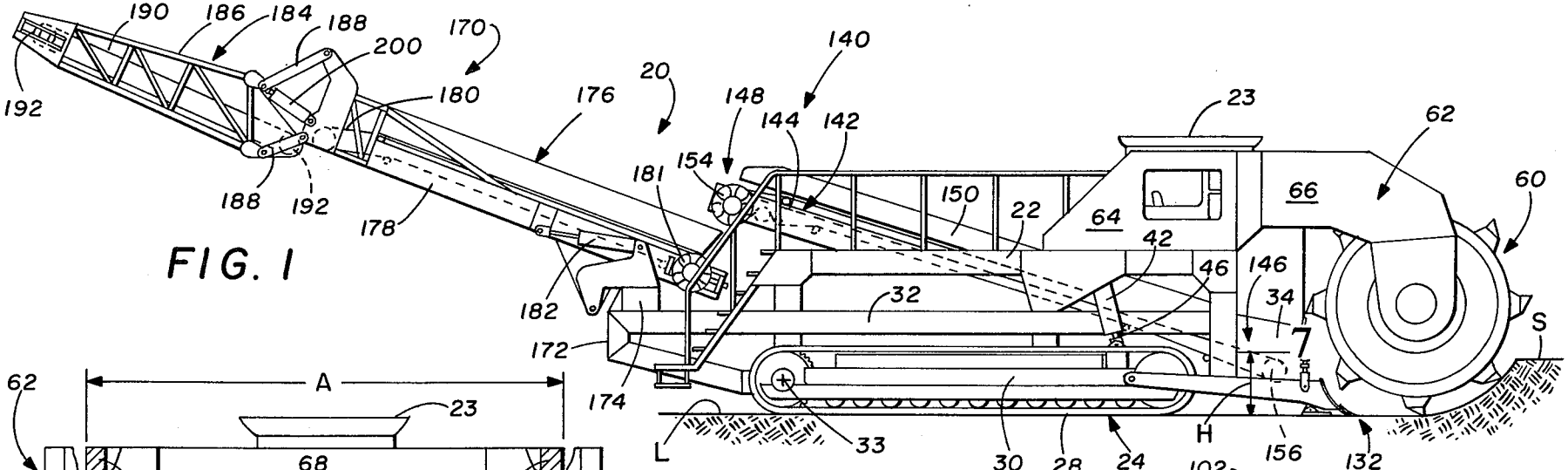
FIG. 1 is a side elevation of an excavating and loading system comprising the present invention.

Referring now to the Drawings, and particularly to FIG. 1, an excavating and loading system 20 incorporating the invention is shown. The system 20 comprises a vehicle 22 with an operator cab 23 and track type wheels 24 for movement along a surface L. Each of the wheels 24 comprises an endless track 28 whereby the excavating and loading system 20 is adapted for movement over highways and other paved surfaces as well as for operation in unpaved areas, such as during an excavating operation.

Figure 2:
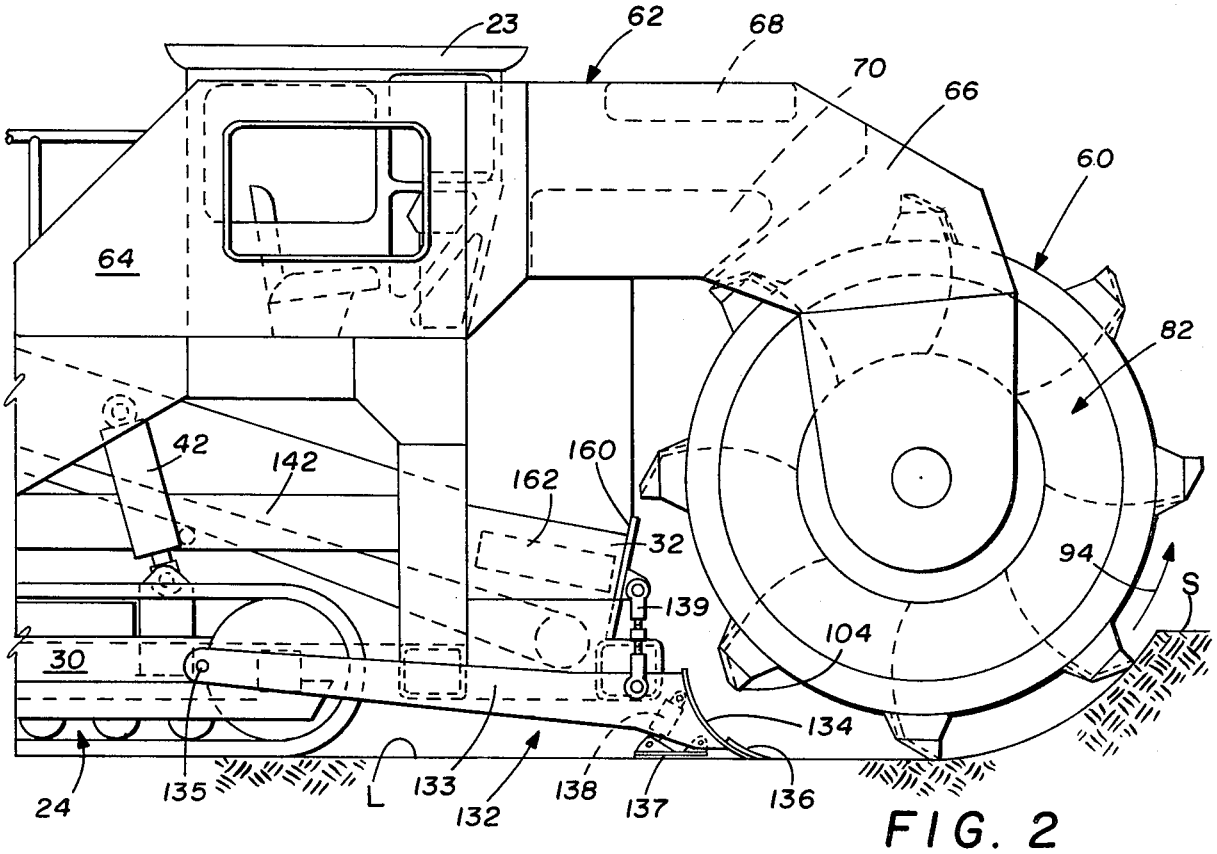
FIG. 2 is a partial enlarged side elevation of the front portion of the excavating and loading system illustrated in FIG. 1.

As is best illustrated in FIG. 2, the wheels 24 are supported from a main frame 30. A subframe 32 is pivotally connected to the main frame 30 at horizontally extending axis 33. The front end 34 of the subframe 32 is connected to the main frame 30 by means of a pair of double-acting hydraulic cylinder assemblies 42. The rod 46 of each hydraulic cylinder assembly 42 is connected to the main frame 30. By selectively actuating the hydraulic assemblies cylinder 42, the height H of the front end 34 of the subframe 32 can be raised or lowered. It will be apparent to those of skill in the art the vehicle 22 can be provided with such other types of wheels and frame structures as may be indicated by particular circumstances.

In accordance with the illustrated embodiment of the invention, an engine (not shown) is supported on the subframe 32. The engine is preferably of the internal combustion type and functions to drive a plurality of hydraulic pumps. The hydraulic pumps in turn supply operating power through suitable controls in cab 23 for the various components of the excavating and loading system 20. For example, one of the pumps supplies operating power for a hydrostatic drive which is in turn coupled to a transmission. The transmission in turn provides driving power for the wheels 24 to propel the excavating and loading system 20 during excavating operations and during travel.

Figure 5:
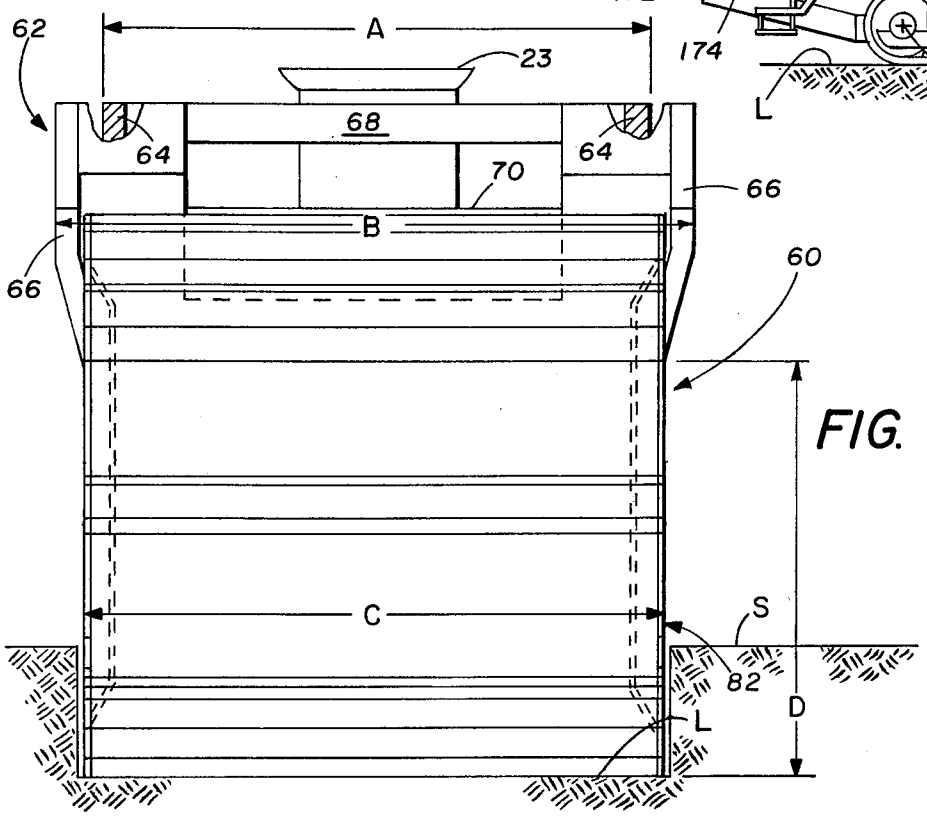
FIG. 5 is a sectional view taken on line 5—5 of FIG. 3, looking in the direction of the arrows.

An excavating wheel assembly 60 is positioned on the forward portion of the vehicle 22. The excavating wheel assembly 60 includes supporting and housing apparatus 62 extending from the front of the subframe 32. The supporting and housing apparatus 62 comprises a pair of side plates 64 which are rigidly connected to the subframe 32 at the sides of the cab 23. As is illustrated in FIG. 5, the outside surfaces of the plates 64 are spaced apart a distance A which represents the maximum width of the vehicle 22. A bifurcated wheel engaging part of the supporting and housing apparatus 62 is formed by portions 66 which extend from the plates 64. The outside surfaces of the portions 66 are spaced apart a distance B, which is wider than the maximum width A of the vehicle. Cross members 68 and 70 interconnect the portions 66.

The excavating wheel assembly 60 further comprises at least one excavating wheel 82 supported between the portions 66 for rotation about a horizontally-extending axis. The excavating wheel 82 includes a pair of rims 84 which extend radially outward along the sides of the wheel. The rims 84 define the overall width of the wheel 82 with the outside surfaces of rims 84 spaced a distance C. The distance C is the excavation width of the excavating wheel 82. In the embodiment illustrated, the width C is greater than the vehicle width A, but less than the width B of the portions 66.

A shaft 86 is fixed between the portions 66 to extend in a horizontal direction. Each of the rims 84 is rotatably supported from the shaft 86 by bearings 88. The portions 66 extend axially from the sides of the wheel and are positioned vertically above the bottom of wheel 82 by a distance D.

A pair of hydraulic motors 90 is positioned inside the wheel 82 and is supported from flanges 91 in a fixed angular position relative to shaft 86. A pair of internal ring gears 92 is likewise positioned inside the wheel 82 adjacent to the rims 84. Each of the motors 90 is provided with an output sprocket which engages one of two ring gears 92 mounted inside wheel 82 to drive wheel 82 to rotate in the direction of arrow 94 as shown in FIG. 2. Hydraulic lines communicating with the motors 90 extend through the apparatus 62. It is to be understood, of course, that one motor could be utilized to drive the sheel 82.

Figure 4:
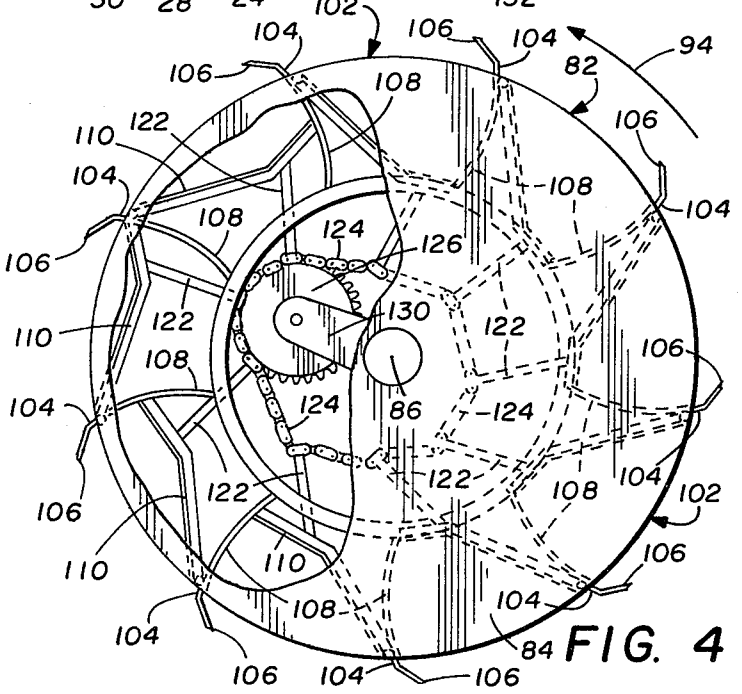
FIG. 4 is a side elevation partly in section of the system of actuating the rear plates of the digging buckets of the excavating and loading systemm incorporating the present invention.

As shown in FIG. 4, the wheel 82 further comprises a plurality of digging buckets 102 which are equally spaced circumferentially around the wheel 82 and extend between the rims 84. The digging buckets 102 each have a cutting edge 104, including a plurality of teeth 106 and a stationary front wall 108, extending generally radially inward from the cutting edge 104. Each digging bucket further includes a rear wall 110, which is supported for movement between a digging position and a dumping position. The operation of the rear wall 110 is best shown in FIG. 4, wherein the wall is shown manipulated between a digging position where the respective buckets 102 are in the lower and forward position of their rotary motion and to a dumping position when the respective buckets are in the upper and rearward position of their rotary motion.

Figure 3:
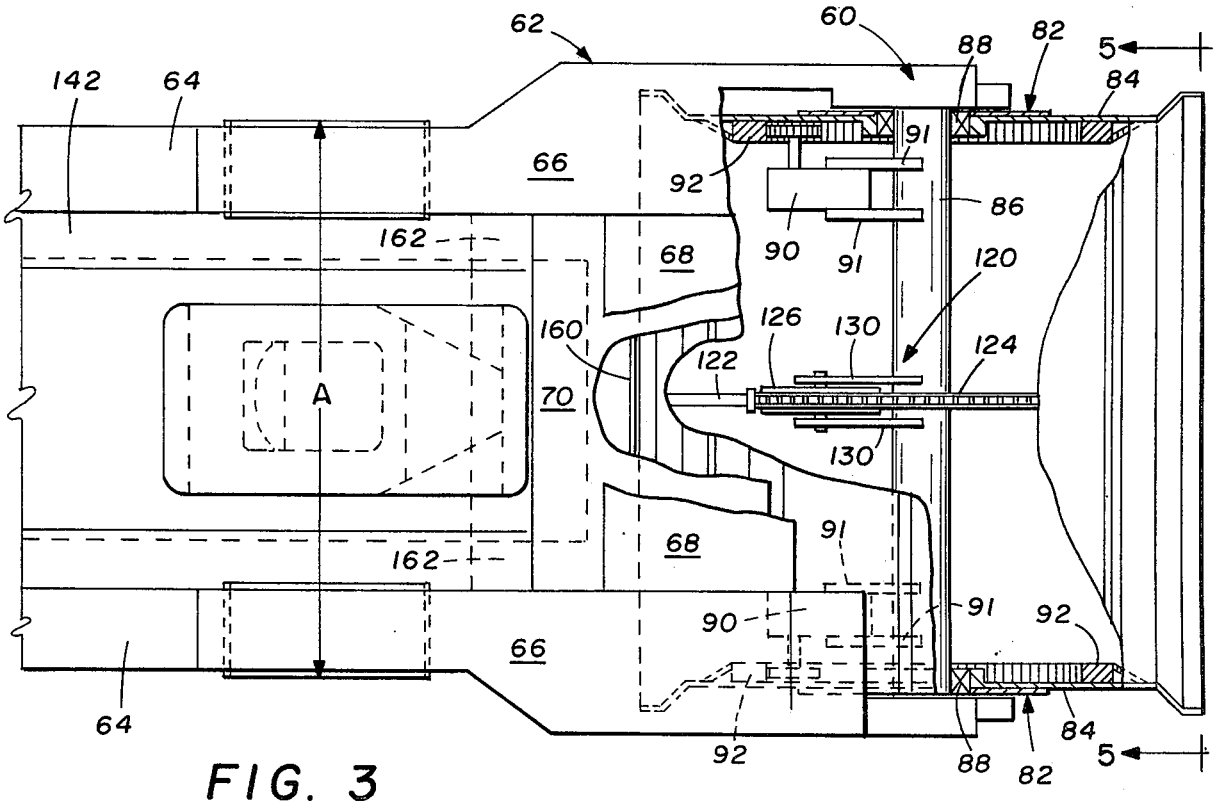
FIG. 3 is a partial enlarged plan view of the front portion of the excavating and loading system illustrated in FIG. 1.

Referring particularly to FIG. 3 and 4, an example of an actuating system 120 for the movable walls of the digging buckets is shown. The system 120 is located completely within the margins of wheel 82 and comprises a plurality of push rods 122, each of which is connected between one of the rear walls 110 and a chain 124. The chain 124 is generally unconstrained, but extends around a roller 126 which is supported on the shaft 86 and which is secured against angular movement relative to the shaft 86 by brackets 130. The roller 126 is sprocketed on its outer periphery to engage the chain 124. As the excavating wheel 82 is rotated about the shaft 86 under the action of motors 90, each push rod 122 comes into engagement with the roller 126 whereupon its respective rear wall 110 is pushed outwardly to the material dumping position. Subsequently, as each digging bucket is rotated to the lower and forward portion of the circular path, the chain operates through the push rod 122 to positively return the rear wall 110 to the material digging position. This positive action of the rear wall 110 in both directions has been found to be vastly superior to the arrangement that has been used herebefore wherein the rear portions were allowed to return to the digging position under the action of gravity and/or the crowding of excavated material into the buckets. It is invisioned, of course, that other positive acting actuating systems could be used, such as those described in the earlier copending application, Ser. No. 435,296, now U.S. Pat. No. 3,896,571, the disclosure of which is incorporated herein by reference.

Positioned below and behind the excavating wheel 82 is a moldboard assembly 132. This moldboard assembly extends completely across the width of the wheel 82 and is provided to pick up loose material and crowd material in a forward direction as the excavating and loading system 20 moves. The assembly comprises a plate 134 which is curved to conform to the path of travel at the edges 104. A blade 136 is positioned adjacent the lower edge of the plate 134. The plate 134 is rigidly supported between a pair of arms 133. These arms 133 are pivotally attached at 135 to frame 30. A bearing plate 137 is pivotally supported at its leading edge from the rear of the plate 134. A selectively operable double-acting hydraulic cylinder means 138 is pivotally coupled between the trailing edge of the bearing plate 137 and the plate 134. A pair of variable length links 139 are coupled between subframe 32 and arms 133. In the illustrated embodiment, the link 139 is a turnbuckle, but it is to be understood, of course, that other links such as hydraulic cylinders, and the like, could be used.

Operation of the assembly 132 is semiautomatic. The position of the blade 136 is controlled by the relative positions of frame 30 and subframe 32. By manipulating control means provided in the cab 23, the effective length of the hydraulic cylinder 138 can be selectively varied to vary the position of the bearing plate 137. Thus, the bearing plate 137 can be adjusted to set the downward vertical pressure of the plate to reduce bouncing and stabilize the excavating system.

As is illustrated in FIGS. 1 and 2, the excavating and loading system 20 further includes a loading system 140. The loading system 140 includes a main conveyor 142 comprising an endless belt 144 mounted for movement around a course extending angularly upwardly relative to the subframe 32 of the vehicle 22 and including a lower material receiving portion 146 and an upper material delivery portion 148. More particularly, the course of the belt 144 is defined by a plurality of rollers (not shown) which are supported on a conveyor frame 150. The conveyor frame 150 is supported on the subframe 32 of the vehicle 22 and includes means supporting the upper portion 148 for pivotal movement about a horizontal axis under the action of the hydraulic cylinder (not shown). This permits control of the vertical height and allows folding of the material delivery portion 148 of the conveyor 142.

Belt 144 of the main conveyor 142 extends around a drum mounted at the upper end of the frame 150 and around a drum 156 mounted on the subframe 32. The upper drum is rotated by hydraulic motor 154 and the lower drum 156 is rotated by a similar motor (not shown). By this means, the belt 44 is moved around the course defined by the rollers to move material from the material receiving portion 146 to the material discharge or delivery portion 148.

A chute 160 is supported from the subframe 32 behind and below the excavating wheel 82 to receive material discharged from the buckets 102. The chute 160 is shaped to direct the material onto the material receiving portion 146 of the main conveyor 142 and to side delivery conveyors 162. This chute 160 and conveyors 162 transport material excavated by the excavating wheel 82 onto the main conveyor 142 for transportation thereby from the material receiving portion 146 to the material delivery portion 148.

Referring now, particularly to FIG. 1, the disclosed embodiment of the invention further includes an auxiliary conveyor system 170. The auxiliary conveyor system 170 includes a frame 172 which is secured to the rear end of the subframe 32 of the vehicle 22. A turntable 174 is supported on the frame 172 for pivotal movement about a vertical axis under the action of hydraulic motor (not shown).

An inner conveyor 176 is supported on the turntable 174 to receive material discharged from the material delivery portion 148 of the main conveyor 142. The conveyor 176 comprises a frame 178 which is supported on the turntable 174 and an endless belt 180 mounted for movement around the course defined by a plurality of rollers. The belt 180 is drive by a hydraulic motor 181, and a hydraulic cylinder 182 is provided for controlling the angular relationship of the frame 178 to the turntable 174.

The auxiliary conveyor system 170 further includes an outer conveyor 184 comprising a frame 186 which is supported from frame 178 by upper and lower parallel links 188. An endless belt 190 is supported on the frame 186 for movement around a course defined by a pair of drums 192. The conveyor 184 is driven by small hydraulic motors (not shown) mounted in the drums 192.

A hydraulic cylinder 200 is pivotally connected between the frames 178 and 186 to manipulated the outer conveyor 184 with respect to the inner auxiliary conveyor 176. In this manner, the outer conveyor 184 may be manipulated to selectively receive material from the inner conveyor 176.

In operation, the excavating and loading system 20 incorporated in the present invention, will be moved to the site by means of wheels 24. Hydraulic cylinder 42 will be adjusted as desired so that the excavating wheel assembly 60 will excavate at the desired depth. Moldboard assembly 132 will be adjusted to the desired position by changing the effective length of the cylinder 42 through manipulating of the controls in the cab. Thereafter, the excavating wheel 82 can be rotated to excavate material from in front of the vehicle. This excavation area will have a width C equal to the width of the excavating wheel 82 and can have a depth from the ground surface S to the lowest level of excavation L, not to exceed dimension D, which is the clearance height from the bottom of the excavating wheel of the wheel engaging portion 66.

As will be appreciated by those of ordinary skill in the art, the width C is wider than the width A of the following portion of the excavating and loading system 20, and thus, the excavating and loading system 20 can move through the excavation formed by the wheel 82. It will also be appreciated by those of ordinary skill in the art, that the spacing between the wheel engaging portions 66, B is greater than the width C area, being excavated by the wheels 82, but these portions of the supporting and housing means 62 are positioned above the maximum depth D at which the excavating and loading system 62 will excavate.

It is to be understood, of course, that the wheel engaging portion 66 could be positioned to extend from the ends of the excavating wheel 82 at a height higher than the center of rotation of the wheel 82. In this manner, the wheel 82 could be utilized to excavate at depths equal to or even greater than the radius of the wheel 82 itself.

Figure 6:
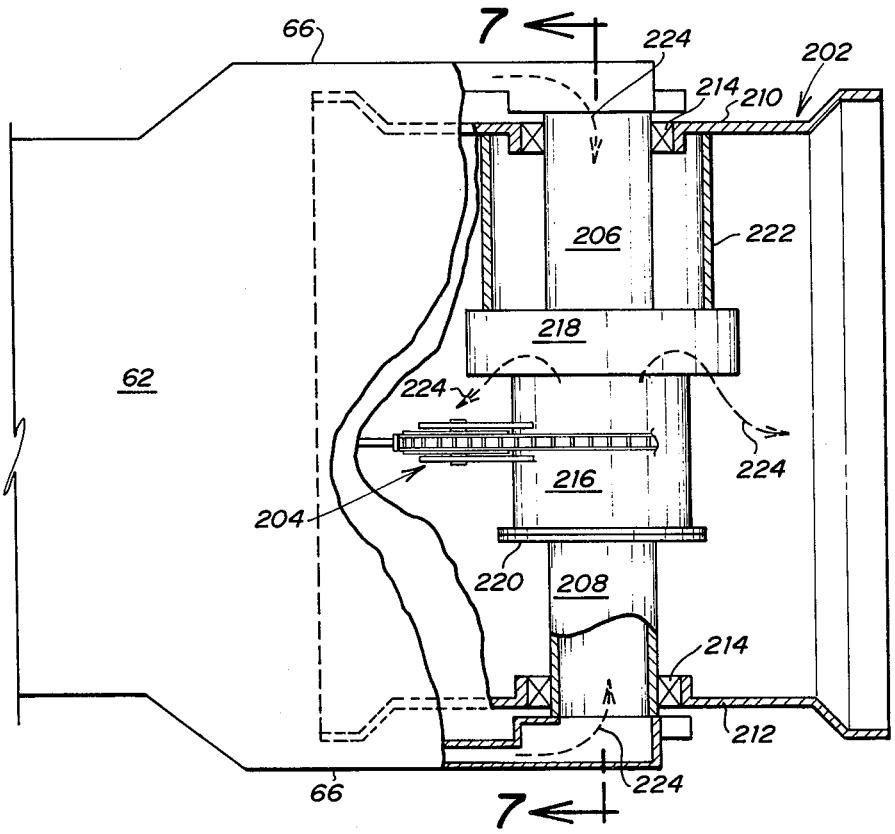
FIG. 6 is a sectional view similar to FIG. 3 of an alternate embodiment of the excavating wheel assembly.
Figure 7:
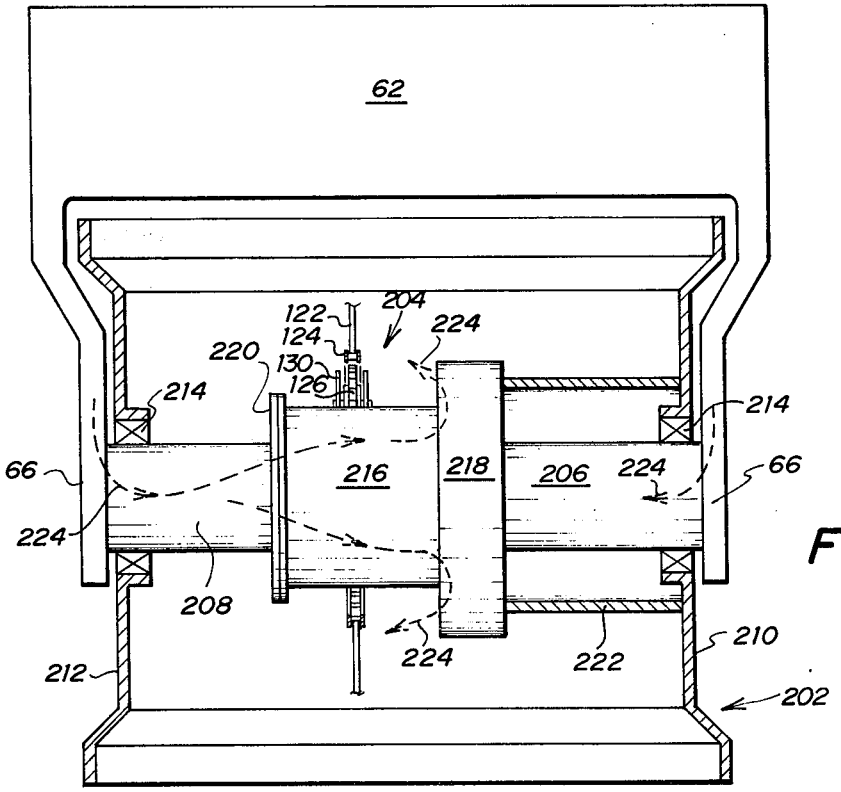
FIG. 7 is a sectional view taken on line 7—7 of FIG. 6; looking in the direction of the arrows.

In FIGS. 6 and 7 an alternate configuration of the excavating wheel assembly is illustrated. The second embodiment of the excavating wheel assembly 202 is carried by the supporting and housing apparatus 62 and contacts the wheel engaging portions 66. The excavating wheel assembly 202 comprises a plurality of digging buckets, not shown, which are identical in construction to the digging buckets 102 on the wheel 82. In addition, a bucket actuation system 204 is provided for moving the walls of the digging buckets. This sytem 204 is identical in construction to the bucket actuation system illustrated in FIGS. 3 and 4 and described above.

The wheel 202 is identical to the wheel 82 in all aspects except the driving means. The wheel 202 illustrated in FIGS. 6 and 7 is driven by an electrically powered system. In this embodiment, it is to be understood, of course that the excavating and loading system 20 is provided with a motor-generator assembly for providing electrical power for the wheel 202.

As can be seen in FIG. 6, the wheel 202 is supported from shafts 206 and 208, which extend from opposite portions 66. These shafts are hollow for reasons which will be pointed out hereinafter. The wheel 202 has rims 210 and 212 which are rotatably supported from the shafts 206 and 208, respectively, by bearings 214. An electric motor 216 and a planetary gearbox reducer 218 are positioned inside the wheel 202 and are supported on shafts 206 and 208. Suitable electrical conductors, not shown, are connected to the motor 216, and extend through the apparatus 62 to the cab 23. Conventional controls are provided in the cab 23 for controlling the operation of the motor 216.

The motor 216 has a housing with an endplate 220 which is fixed to the shaft 208. The gearbox 218 is in turn supported between the shaft 206 and the motor 216. The bucket wall actuation system 204 is supported from the exterior of the housing of the motor 216, as shown.

The motor 216 is operatively connected to the gearbox 218. The gearbox 218 is conventional in design and provides a speed reducing function for the output of the motor 216. A planetary gear provides the output from the gearbox 218 and this planetary, not shown, is coupled to a sleeve 222, concentric with the shaft 206. The sleeve 222 is in turn connected to the rim 210. In this manner, the motor 216 drives the gearbox 218 which in turn rotates the sleeve 222, which in turn rotates the wheel 202 through rim 210. Thus, an electric motor 216 is used to drive the wheel 202.

According to another feature of this embodiment, cooling air is supplied to the motor 216 through the supporting and housing apparatus 62. Conduits, not shown, are provided in the apparatus 62 to communicate with the hollow interior of the wheel engaging portions 66. A blower can be provided to force air through the conduits and into the hollow interior of the portions 66. As can be seen in FIG. 6, the interiors of the portions 66 communicate with the hollow interiors of the shafts 206 and 208 to carry air to the interior of the wheel 202. The arrows 224 represent the flow of cooling air into the interior of the wheel 202. As can be seen, the hollow interiors of the shaft 206 and 208 supply cooling air to the interior of the gearbox 218 and motor 216. The air can flow through the motor 216 and be exhausted into the interior of the wheel 202. Thus, an embodiment for using an electric motor to power the excavating wheel 202 is disclosed with cooling air flow.

From the foregoing, it will be understood that the present invention comprises additional improvements relating to excavating and loading systems disclosed and claimed in copending application, Ser. No. 435,296, filed Jan. 21, 1974, now U.S. Pat. No. 3,896,571 issued July 29, 1975.

Thus, in accordance with the invention described herein, an excavating and loading system comprising a vehicle having an excavating wheel assembly supported on the front thereof is provided for excavating the material and transferring the material to a main conveyor whereupon the material is conveyed to the rear of the vehicle. The excavating wheel itself is of a width wider than the following portion of the vehicle. The supporting and housing apparatus which supports the excavating wheel from the vehicle has portions which extend from the sides of the wheel and are positioned a vertical height in excess of the excavation depth. In this manner, the excavation wheel forms an excavation wider than the following portion of the vehicle allowing the vehicle to be supported and travel through the excavation as it is formed.

The advantages of this particular arrangement allow for outside engagement of the excavating wheel, which in turn provides for a stable and uncomplicated system of operating the buckets. In addition, this arrangement increases the width of the excavation formed by a particular system and pemits operation of the excavating and loading system within the excavation that is being formed. This materially reduces the amount of movement of the excavating wheel assembly necessary to position the assembly for excavation and travel and thereby reduces the overall complexity of the excavating and loading system incorporating the present invention.

It is to be understood, of course, by those of ordinary skill in the art, that although the vehicle is illustrated with the track type wheels, conventional tired wheels could be utilized. In addition, the system is shown as utilizing an internal combustion engine with hydraulic pumps and motors to operate various elements of the system. It is envisioned that an internal combustion engine could be used with electric generators and motors to operate the various elements of the system without departing from the present invention.

Although particular embodiments of the invention have been illustrated in the accompanying Drawings and described in the foregoing Detailed Description, it will be understood that the invention is not limited to the embodiments disclosed, but is capable of numerous rearrangements, modifications, and substitution of parts and elements without departing from the spirit and scope of the invention as defined in the appended claims.

What is claimed is:

1. An excavating and loading system comprising in combination:

a vehicle including a main frame and a subframe;

means supporting the main frame of the vehicle for movement over a surface;

excavating wheel means for forming an excavation including a plurality of digging buckets located immediately adjacent one another to define the entire circumference of the excavating wheel and each having a cutting edge which extends to a stationary wall and a wall mounted for pivotal movement from a material receiving position to a material dumping position, each end of said excavating wheel means defining a side wall and an outer rim extending axially beyond the side wall, said rims of the excavating wheel means being wider than the vehicle;

supporting and housing means on the vehicle supported from the subframe and supporting said excavating wheel means in the front of the vehicle, said supporting and housing means including portions engaging and rotatably supporting the ends of said excavating wheel means and extending vertically upwardly in the space between the side walls and the rims to portions extending outwardly beyond said rims whereby the distance between the lowest point on said outwardly extending portions and the lowest digging level of said excavating wheel means defines the maximum excavation depths;

means for selectively varying the relative positioning of said subframe and said main frame whereby said excavating wheel means can be selectively raised or lowered to excavate at various depths;

drive means extending in part through the supporting and housing means for rotating the excavating wheel means so that the digging buckets follow a circular path;

means located within the margins of the excavating wheel means and responsive to rotation thereof for positively positioning the movable wall of each digging bucket in the material dumping position when the bucket is in the upper and rearward portion of the path; and conveyor means mounted on the vehicle entirely behind the excavating wheel assembly for movement around a course including a relatively low portion positioned to receive material from the digging buckets of the excavating wheel means and the material dumping position relatively high and located rearwardly on the vehicle.

2. The excavating and loading system of claim 1 wherein said excavating wheel means is cylindrical and is rotated about its axis, and wherein the supporting and housing means includes axle means extending through the excavating wheel means and defining said axis.

3. The excavating and loading system of claim 1 wherein the drive means includes motor means mounted within the excavating wheel means for rotating the excavating wheel means, and power means extending through the supporting and housing means to the motor means.

4. The excavating and loading system of claim 1 wherein the bucket wall positioning means functions to positively pivot the moveable wall of each digging bucket to the material dumping position during a first portion of the rotation of the excavating wheel means and to positively pivot the moveable wall in the material receiving position during a subsequent portion.

5. An excavating and loading system comprising in combination;

a vehicle;

means supporting the vehicle for movement over a surface;

excavating wheel means for forming an excavation including a plurality of digging buckets each having a cutting edge which extends to a stationary wall and a wall mounted for pivotal movement from a material receiving position to a material dumping position, each end of said excavating wheel means defining a side wall and an outer rim extending axially beyond the side wall so that said excavating wheel means is wider at its periphery than the widest portion of the lower portion of the vehicle;

means pivotably attached to said vehicle and supporting the excavating wheel means on the vehicle whereby the excavating wheel means is positioned in the front of the vehicle, said means supporting said excavating wheel having portions extending axially out from and engaging and rotatably supporting the ends of the excavating wheel means and extending vertically upwardly therefrom in the spaces between the side walls and the rims and portions extending outwardly beyond the rims of said excavating wheel means whereby the distance between the lowest point on said outwardly extending portions and the lowest digging level of said excavating wheel means defines the maximum excavation depth;

means for selectively varying the relative position of said excavating wheel means and said vehicle whereby said excavating wheel means can be selectively raised or lowered to excavate at various depths;

drive means for rotating the excavating wheel means so that the digging buckets follow a circular path;

means located within the margins of the excavating wheel means and responsive to rotation thereof for positively positioning the movable wall of each digging bucket in the material dumping position when the bucket is in the upper and rearward portion of the path; and conveyor means mounted on the vehicle entirely behind the excavating wheel assembly for movement around a course including a relatively low portion positioned to receive material from the digging buckets of the excavating wheel means and a relatively high discharge position located rearwardly on the vehicle.

6. The excavating and loading system of claim 5 wherein said excavating wheel means is cylindrical and is rotated about its axis, and wherein the supporting and housing means includes axle means extending through the excavating wheel means and defining said axis.

7. The excavating and loading system of claim 5 wherein the drive means includes motor means mounted within the excavating wheel means for rotating the excavating wheel means, and power supply means extending through the supporting and housing means to the motor means.

8. The excavating and loading system of claim 5 wherein the bucket wall positioning means functions to positively pivot the movable wall of each digging bucket to the material dumping position during a first portion of the rotation of the excavating wheel means and to positively pivot the movable wall to the material receiving position during a subsequent portion.

9. In an excavating and loading system having in combination a vehicle including a main frame and a subframe, means supporting the main frame of the vehicle for movement over a surface, excavating wheel means for forming an excavation and including a plurality of digging buckets located immediately adjacent one another to define the entire circumference of the excavating wheel means and each having a cutting edge which extends to a stationary wall land a movable wall mounted for pivotal movement from a material receiving position to a material dumping position, each end of said excavating wheel means defining a side wall and an outer rim extending axially beyond the side wall, said excavating wheel means being wider than the widest portion of the vehicle, supporting and housing means rotatably supporting the excavating wheel means from the subframe whereby the excavating wheel means is positioned in the front of the vehicle, means for selectively varying the relative positioning of the subframe and the main frame whereby the excavating wheel means can be selectively raised or lowered to excavate at various depths, drive means extending in part through the supporting and housing means for rotating the excavating wheel means so that the digging buckets follow a circular path, means located within the margins of the excavating wheel means and responsive to rotation thereof for positively positioning the movable wall of each digging bucket in the material dumping position when the bucket is in the upper and rearward portion of the path, conveyor means mounted on the vehicle entirely behind the excavating wheel means for movement around a course including a relatively low portion positioned to receive material from the digging buckets of the excavating wheel means and a material dumping position located rearwardly and upwardly on the vehicle;

the improvement which comprises said supporting and housing means comprising portions engaging the ends of said excavating wheel means to rotatably support said excavating wheel means and extending upwardly therefrom in the spaces between the side walls and the rims of the excavating wheel means and portions extending from said spaces to clear said rims whereby the distance between the lowest points on said extending portions and the lowest digging level of said excavating wheel means is greater than the depth of said excavation.

10. An excavating and loading system comprising in combination:

a vehicle;

means supporting the vehicle for movement over a surface;

excavating wheel means for forming an excavation and including a plurality of digging buckets each having a cutting edge which extends to a stationary wall and a wall mounted for pivotal movement from a material receiving position to a material dumping position, each end of said excavating wheel means defining a side wall and an outer rim extending axially beyond the side wall, said excavating wheel means being wider then the widest portion of the vehicle;

means rotatably supporting the excavating wheel means on the vehicle whereby the excavating wheel means is positioned in the front of the vehicle, said supporting means having portions engaging the ends of said excavating wheel means, portions extending vertically upwardly therefrom in the spaces between the side walls and the rims, and portions extending beyond the rims of the excavating wheel means whereby the distance between the lowest points on said outwardly extending portions and the lowest digging level of said excavating wheel means is greater than the depth of said excavation;

means for selectively varying the relative positioning of the excavating wheel means and the vehicle whereby the excavating wheel means can be selectively raised or lowered to excavate at various depths;

drive means extending in part through the supporting means for rotating the excavating wheel means so that the digging buckets follow a circular path;

means located within the margins of the excavating wheel means and responsive to rotation thereof for positively positioning the movable wall in the material dumping position when the bucket is in the upper and rearward portion of the path; and conveyor means mounted on the vehicle entirely behind the excavating wheel assembly for movement around a course including a relatively low portion positioned to receive material from the digging buckets of the excavating wheel means and a relatively high material discharging position and located rearwardly on the vehicle.

11. The excavating and loading system of claim 10 wherein said excavating wheel means is cylindrical and is rotated about its axis, and wherein the supporting and housing means includes axle means extending through the excavating wheel means and defining said axis.

12. The excavating and loading system of claim 10 wherein the drive means includes motor means mounted within the excavating wheel means for rotating the excavating wheel means, and power supply means extending through the supporting and housing means to the motor means.

13. The excavating and loading system of claim 1 wherein the bucket wall positioning means functions to positively pivot the movable wall of each digging bucket to the material dumping position during a first portion of the rotation of the excavating wheel means and to positively pivot the movable wall to the material receiving position during the subsequent portion.

* * * * *